United States Patent [19]

House et al.

[11] 4,365,306

[45] Dec. 21, 1982

[54] METHOD AND APPARATUS FOR REMOTELY MONITORING AND EVALUATING PILE DRIVING HAMMERS

[75] Inventors: Horace F. House, Houston, Tex.; Marvin L. Peterson; Norman W. Hein, Jr., both of Ponca City, Okla.

[73] Assignee: Conoco Inc., Ponca City, Okla.

[21] Appl. No.: 164,636

[22] Filed: Jun. 30, 1980

[51] Int. Cl.[3] ..... G06M 3/06; G06F 7/00

[52] U.S. Cl. ..... 364/551; 364/506; 364/569; 235/92 T; 235/92 TF; 173/20

[58] Field of Search ..... 364/476, 505, 506, 551, 364/569; 367/131, 134; 173/1, 2, 11, 20, DIG. 1; 73/11, 84; 235/92 TF, 92 DP, 92 T

[56] References Cited

U.S. PATENT DOCUMENTS

| | | | |
|---|---|---|---|
| 2,735,292 | 2/1956 | Apps | 73/69 |
| 2,820,361 | 1/1958 | Apps | 73/67 |
| 3,498,388 | 2/1970 | Jovis | 173/3 |
| 3,714,789 | 2/1973 | Chelminski | 173/1 X |
| 3,721,095 | 3/1973 | Chelminski | 173/1 X |
| 3,930,248 | 12/1975 | Keller | 364/506 X |
| 4,023,396 | 5/1977 | Yakshin et al. | 364/506 X |
| 4,048,474 | 9/1977 | Olesen | 364/569 X |
| 4,051,351 | 9/1977 | Miller et al. | 73/115 X |
| 4,052,884 | 10/1977 | Milberger et al. | 73/84 X |
| 4,119,941 | 10/1978 | Moore et al. | 367/134 |
| 4,131,164 | 12/1978 | Hague et al. | 173/2 X |
| 4,142,238 | 2/1979 | Brandt et al. | 364/569 X |
| 4,147,222 | 4/1979 | Patten et al. | 367/134 |
| 4,161,787 | 7/1979 | Groves | 235/92 DP X |
| 4,168,525 | 9/1979 | Russell | 364/569 |
| 4,176,337 | 11/1979 | Aechter et al. | 364/569 X |
| 4,179,611 | 12/1979 | Mill et al. | 235/92 TF X |
| 4,200,910 | 4/1980 | Hall | 364/145 |
| 4,210,967 | 7/1980 | Ingram | 364/422 X |
| 4,212,071 | 7/1980 | Dortu | 364/505 |
| 4,215,413 | 7/1980 | Stark et al. | 235/92 TF X |
| 4,245,322 | 1/1981 | Batchelor | 364/569 X |
| 4,250,370 | 2/1981 | Sasaki et al. | 235/92 T X |
| 4,271,475 | 6/1981 | Sahajdak | 73/11 X |
| 4,277,676 | 7/1981 | Kammerer | 235/92 T X |

*Primary Examiner*—Edward J. Wise

*Attorney, Agent, or Firm*—Stephen A. Littlefield

[57] ABSTRACT

A pile driving hammer monitoring apparatus is disclosed to include a pressure wave sensor, such as a hydrophone, remotely located from the pile driving equipment for detecting pressure waves generated by the hammer striking a pile. The sensor generates a proportional analog electrical signal which is conditioned into a corresponding digital electrical signal and conveyed to a microcomputer. The microcomputer calculates the hammer blow rate over a predetermined time period or over a selectable time period or distance of pile movement. Data independent of the blow rate information is enterable into the microcomputer by means of presettable multi-position switches. The apparatus can be powered either by an alternating current source or a direct current source.

11 Claims, 4 Drawing Figures

METHOD AND APPARATUS FOR REMOTELY MONITORING AND EVALUATING PILE DRIVING HAMMERS

BACKGROUND OF THE INVENTION

1. Field of the Invention

This invention relates generally to methods and apparatus for determining the rate at which a pile driving hammer strikes a pile and more particularly, but not by way of limitation, to methods and apparatus utilizing electronic instrumentation to monitor offshore pile driving hammers used in the oceanic construction of drilling platforms and the like.

2. Description of the Prior Art

In building such structures as offshore drilling platforms it is often necessary to drive structural supports, or piles, by suitable pile driving equipment, such as a pile driving hammer, as is known in the art. Although the same pile driving hammer may be used on different jobs, the optimum rates over time and distance at which the pile driving hammer strikes the pile to drive it into the supporting surface can vary from job to job because the size and strength of the driven pile may differ, the depth to which the pile has been or is to be driven may vary, or the type of soil into which the pile is to be driven may vary, for example. Therefore, to control the quality of operation of the pile driving hammer for the specific job on which it is being used, it is necessary to monitor the hammer to determine if it is striking the pile at the desired rate as determined by the various pertinent factors which can change from job to job. By so monitoring the rate of the pile driving hammer, the hammer can be more efficiently controlled.

This general need for monitoring pile driving operations has been recognized and previous attempts to satisfy it have been made or proposed. For example, one way to monitor the rate at which a hammer strikes a pile is to have a person manually operate a stop watch and counting device so that the number of strikes during a certain time period can be recorded on a chart or in a table, for example. Another means for monitoring the pile driving hammer is to attach a strain gauge to the pile to record the strain in the pile as it is driven into the supporting surface. Also, high speed photography may be used to capture the individual reciprocations of the pile driving hammer as it moves and strikes the driven pile.

Still another type of pile driving monitoring system is disclosed in U.S. Pat. No. 3,498,388 in the name of Jovis. The apparatus disclosed in this patent includes means for comparing the actual rate of the pile driving hammer with a predetermined reference rate and further includes means for providing a tangible recording of the monitored parameters. More particularly, the apparatus is proposed to include an accelerometer affixed to the pile, a rectifier, a monostable multivibrator, a filter, a differential amplifier and a throttle.

U.S. Pat. No. 3,721,095 in the name of Chelminski discloses a controllable force method and system of driving piles which senses pressures in a bounce chamber. As shown in FIG. 4 of the Chelminski patent, the apparatus is proposed to include a pressure transducer which detects the actual pressure in the chamber and a comparator which compares the detected actual pressure with a desired pressure and adjusts the fluid pressure accordingly.

U.S. Pat. No. 4,051,351 in the name of Mallick, Jr. et al. discloses an electronic system for monitoring pneumatic tool performance. The system provides a count of the number of work cycles generated by the pneumatic tool during operation thereof.

U.S. Pat. No. 3,714,789 in the name of Chelminski discloses another type of pile driver method and system.

Although these prior art devices provide pile driving monitoring apparatus, they generally require sensing means to be located either in direct contact with or relatively close to the pile driving hammer and/or pile. Therefore, they do not provide means for simply, quickly and accurately monitoring the blow rate of the pile driving hammer and for obtaining a permanent record of the information derived therefrom when the pile driving hammer is used in building an offshore drilling platform, for example. It is also believed that these devices fail to remotely detect individual strikes of the hammer against the pile. Additionally, it is believed that these previously used or proposed devices fail to provide means for calculating the number of times a pile driving hammer strikes a pile over either a predetermined time period or over a selectable distance of pile movement. It is believed that these devices furthermore do not include the means for entering various types of pile driving hammer data, or other data, into the monitoring equipment.

SUMMARY OF THE INVENTION

The present invention overcomes the above-noted and other shortcomings of the prior art by providing a novel and improved method and apparatus for remotely monitoring and evaluating a pile driving hammer. The present invention achieves a simple, quick and accurate monitoring of the blow rate of the pile driving hammer and provides a permanent record of the monitored information without having any component of the invention physically attached to the pile driving hammer or the driven pile. Even though there is no physical attachment between the present invention and the pile driving equipment, the present invention properly detects individual strikes of the hammer against the pile. Furthermore, the present invention can be operated so that the blow rate of the hammer can be determined either during a predetermined time period or during a selectable distance of pile movement. The present invention also comprises means by which additional information can be input into the system.

Broadly, the present invention provides an apparatus for remotely monitoring and evaluating a pile driving hammer as it drives a pile into a supporting structure. The apparatus includes sensing means, spaced from the pile driving hammer, for sensing pressure waves generated when the pile driving hammer strikes the pile. The apparatus further comprises clock means for providing an electrical timing signal and also comprises electronic computer means, responsive to the sensing means and the clock means, for computing the number of times the pile driving hammer strikes the pile during a predetermined time period. The apparatus also includes control means for controlling the computer means so that the computer means computes the number of times the pile driving hammer strikes the pile during one of a plurality of selectable distances of pile movement. The apparatus also includes data entry means for communicating data to the computer means. To display the number of strikes which occur during either the predetermined time period or one of the plurality of selectable distance periods, the apparatus further comprises display means. The apparatus may be powered by either an alternating current source or a direct current source as provided by alternating current connector means for electrically connecting the apparatus to an alternating current power source or by direct current connector means for electrically connecting the apparatus to a direct current power source.

Therefore, from the foregoing, it is a general object of the present invention to provide a novel and improved method and apparatus for remotely monitoring and evaluating a pile driving hammer. Other and further objects, features and advantages of the present invention will be readily apparent to those skilled in the art when the following description of the preferred embodiments is read in conjunction with the accompanying drawings.

BRIEF DESCRIPTION OF THE PRESENT INVENTION

FIG. 3 is a preferred embodiment schematic circuit diagram of the present invention functionally depicted in FIG. 2.

DETAILED DESCRIPTION OF PREFERRED EMBODIMENTS OF THE INVENTION

Figure 1:
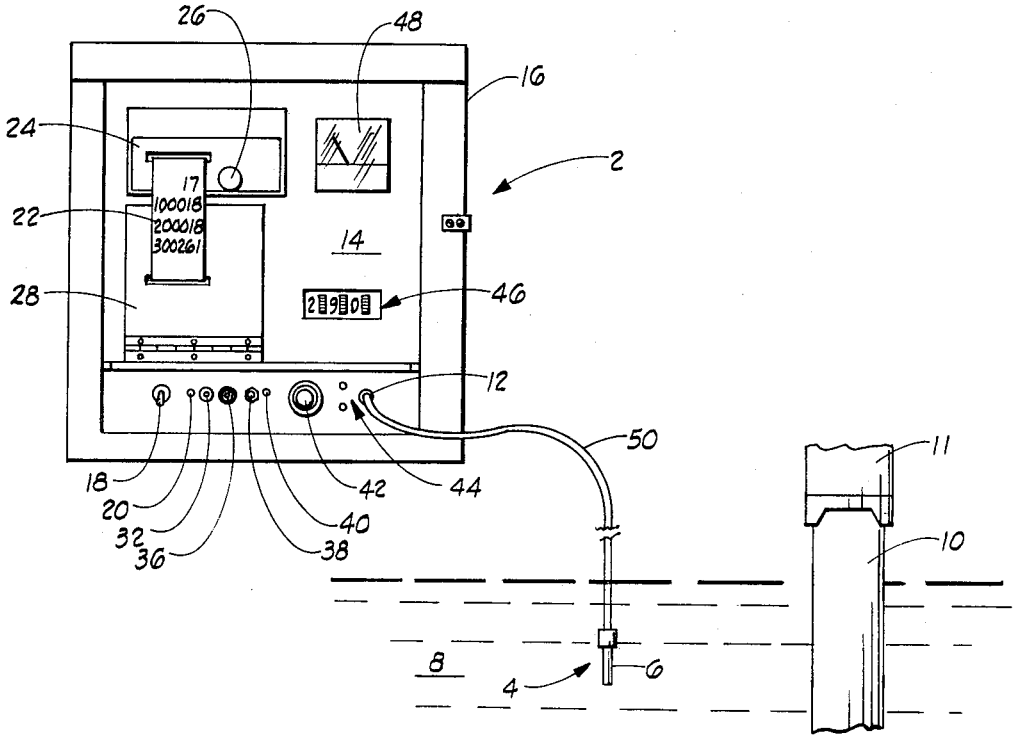
FIG. 1 is a schematic llustration of the present invention associated with a pile being driven into a subsea formation.

With reference now to the drawings a preferred embodiment of an apparatus constructed in accordance with the present invention will be described. The apparatus is generally indicated by the reference numeral 2 as shown by the external view thereof in FIG. 1. The external view of the apparatus 2 discloses that it comprises sensing means 4 which preferrably includes a hydrophone 6 submerged in a body of fluid 8 in which a pile 10 is placed for being driven by a pile driving hammer 11 into the support surface or floor located beneath the fluid. The sensing means 4 is connected to an input jack 12 located on a front panel 14 of a housing 16 which encloses the electronic components of the apparatus 2.

Also disposed on the front panel 14 of the housing 16 is on/off power switch means 18 which couples and decouples a primary power source to the electronic circuitry of the present invention. When the on/off switch means 18 is placed in the "on" position a power-on indicator lamp 20 is illuminated.

When the apparatus 2 is activated by properly actuating the switch means 18 and the sensing means 4 detects an appropriate signal, the electronic circuitry appropriately processes the detected signal as subsequently described, and provides a printed output tape 22 disclosing pertinent information. The output tape 22 is imprinted by appropriate printer means 24 which is located in the housing 16. The printer 24 is of any suitable type as is known in the art, such as a Datel Systems, Inc. DPP-7 unit. Appropriate printer controlling means 26 is provided on the printer 24 as is known in the art.

Enclosed within the housing 16 behind a hinged door 28 is a paper take-up motor which accumulates the printed output tape 22 as it is fed from the printer 24. The paper take-up motor is actuated automatically by the appropriate electronic circuitry of the apparatus 2 or manually by means of a paper take-up switch means 30 (shown in FIG. 3) having an actuating button 32 extending from the front panel 14 of the housing 16. The motor is schematically depicted as element 34 in FIG. 3.

Also extending from the front panel 14 of the housing 16 are a reset switch means control button 36, a locally controllable count period select switch means push button control 38, a blow indicator lamp 40, and a sensitivity adjustment knob 42. The function of each of these four elements will become apparent subsequently. The front panel 14 further includes connector means 44 for coupling with a remotely controllable count period select switch means.

FIG. 1 further shows that the front panel 14 of the housing 16 has thumbwheel switch means 46 disposed therein. The thumbwheel switch means 46 is used to enter various types of data, such as information pertaining to the pile 10 being driven.

The front panel 14 also has an ammeter 48 disposed therein for displaying the number of amperes drawn by the apparatus 2 during its operation.

Figure 2:
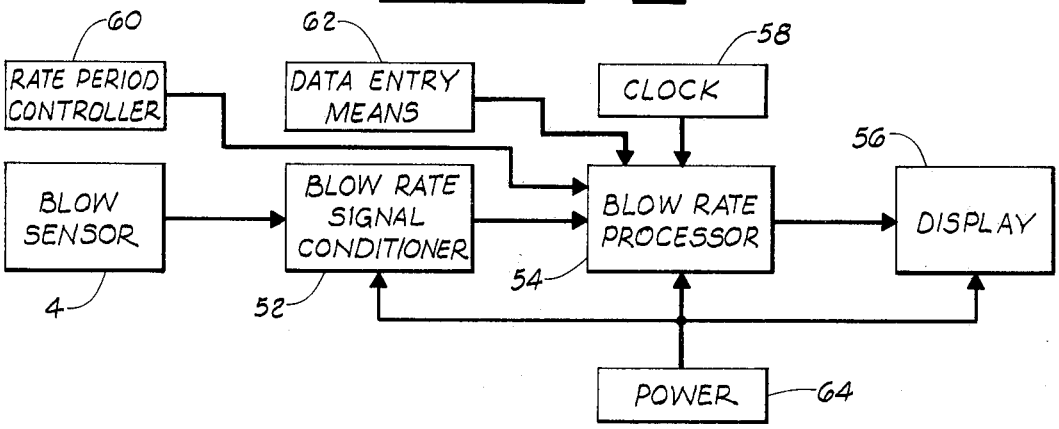
FIG. 2 is a functional block diagram of the present invention.

FIG. 2 discloses a functional block diagram of the elements constituting the apparatus 2 of the present invention. The apparatus 2 includes a blow sensor 4 which corresponds to the sensing means 4 shown in FIG. 1. The blow sensor 4 detects pressure waves generated by the action of the pile driving hammer 11 striking the pile 10 and generates a proportional electrical signal which is transmitted, or conducted via a cable 50 for the embodiment shown in FIG. 1, to a blow rate signal conditioner means 52 which forms a portion of the electronic circuitry contained within the housing 16. The blow rate signal conditioner means 52 provides electrical signals to a blow rate processor means 54 which in turn conveys electrical signals to a display means 56. To provide a time base to the blow rate processor means 54, the apparatus 2 further includes clock means 58. The blow rate processor means 54 normally functions at a rate set by the time base from the clock means 58 under the control of a program to determine the blow rate over a predetermined period of time; however, the apparatus 2 further includes rate period controller means 60 by which this predetermined time period can, in effect, be varied. FIG. 2 also shows the apparatus 2 includes data entry means 62 which permits information other than that received from the blow sensor 4 to be input to the blow rate processor means 54. The energizing force for the electronic circuitry of the apparatus 2 is provided by power supply means 64.

With reference again to FIG. 1 and additionally to FIG. 3, a preferred embodiment of the functional elements disclosed in FIG. 2 will be described. The blow sensor 4 includes the sensing means for detecting the pressure waves which are generated when the pile driving hammer 11 strikes the pile 10. The pressure waves are generally sonic waves and are transmitted through the fluid medium 8 in which the pile 10 and sensor means 4 are located when the present invention is utilized in the environment depicted in FIG. 1. The sensing means 4 converts the pressure into proportional analog electrical "striking" signals which are conveyed to the blow rate signal conditioning means 52 located within the housing 16. So the present invention may be easily used to quickly obtain an evaluation of the pile driving hammer 11, the blow sensor 4 is spaced from the pile driving equipment represented in FIG. 1 by the pile 10 and the hammer 11.

Although it is contemplated that the present invention can be used in any environment to remotely monitor and evaluate the operation of pile driving equipment, it is preferred that the blow sensor 4 include the hydrophone 6, and that the fluid medium 8 in which the hydrophone 6 is placed be a liquid, such as the ocean water in which an offshore drilling platform is built. This is preferred because it has been discovered when the medium 8 is air and the sensor 4 is a microphone, undesirable quantities of distortion arise to adversely affect the operation of the apparatus 2. Utilizing a hydrophone in a liquid medium surrounding the pile eliminates this problem.

Figure 4:
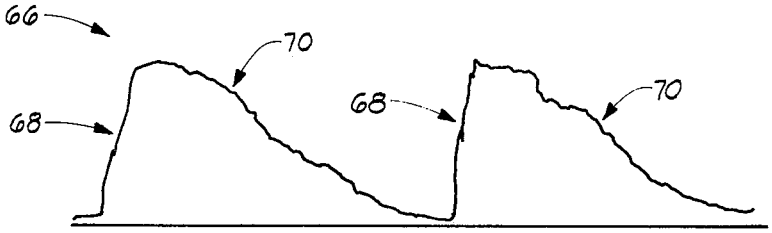
FIG. 4 is an illustration of the response of the preferred embodiment of the sensing means of the present invention to pressure waves received through a liquid medium surrounding the pile shown in FIG. 1.
Figure 1:
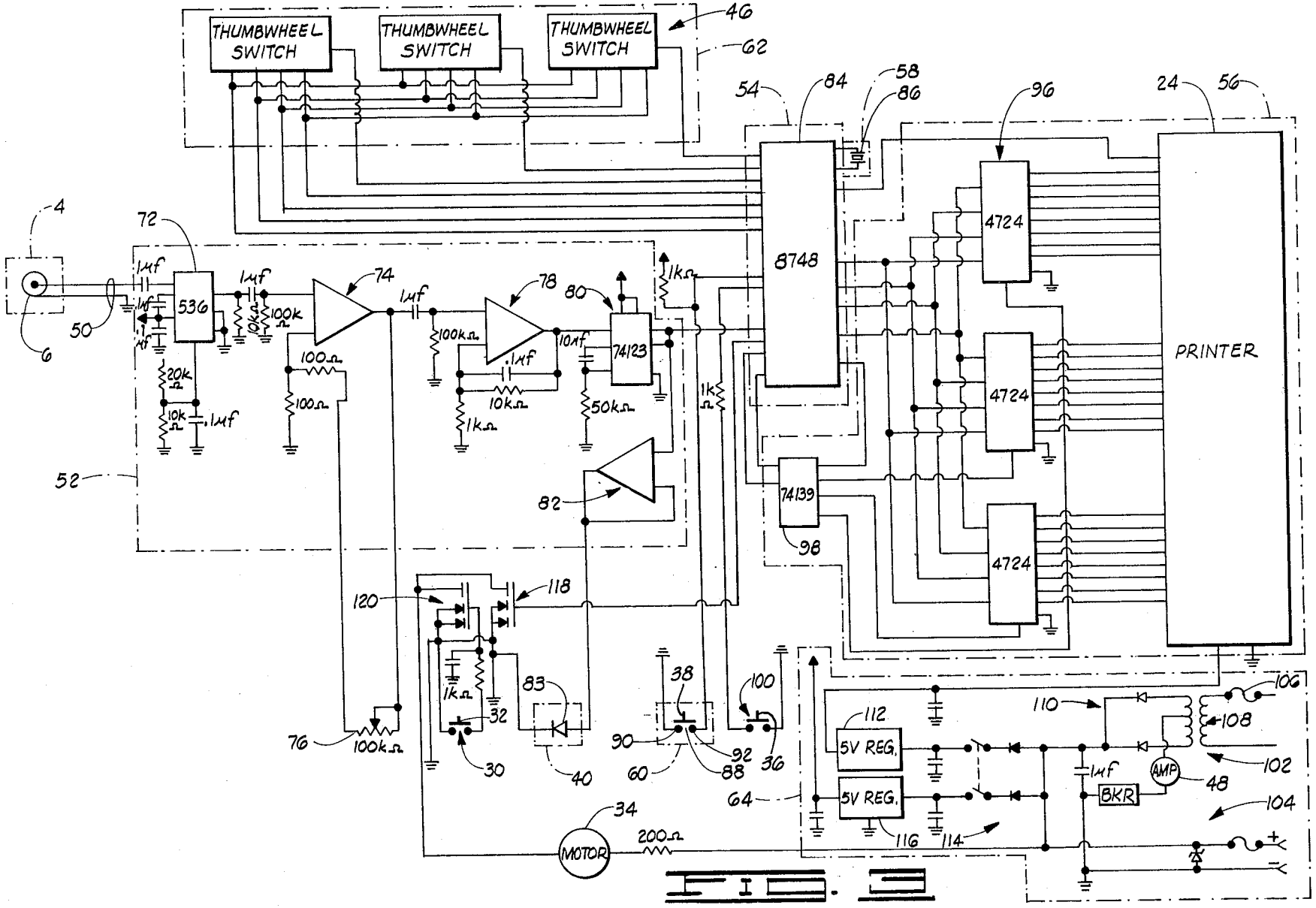

An example of the response of the hydrophone 6 placed in liquid 8 to the hammer 11 striking the pile 10 is shown in FIG. 4 as waveform 66. The illustrated waveform has two substantially pulse-like waveforms, each corresponding to a respective hammer strike of the pile. As will be noted, each pulse-like response has a substantially increasing edge 68 and a substantially decreasing decaying edge 70 which, as will be appreciated by those skilled in the art, preclude false or multiple triggering of digital electronic circuits which are included in the apparatus 2 as hereinafter described. Such substantially smooth pulse-like waves were not achieved by merely placing a microphone in the air and receiving pressure waves through that medium.

As shown in FIG. 1, the hydrophone 6 is preferably connected by means of the cable 50 to the input jack 12 located on the front panel 14 of the housing 16. The cable 50 is of a suitable type as is known in the art. Using the cable 50 one can place the hydrophone 6 at considerable distances from the pile driving equipment and still accurately receive the pressure waves generated by the pile driving action. Even when the hydrophone 6 is disposed several hundred feet from the pile 10 and pile driving hammer 11, a 1:1 ratio of each detected pressure wave to each hammer blow is maintained.

The cable 50 connects the hydrophone 6 to the portion of the electrical circuit identified in FIG. 2 as the blow rate signal conditioner means 52. FIG. 3 indicates the preferred embodiment of the blow rate signal conditioner means 52 includes an integrated RMS-to-DC converter means 72 which receives the analog electrical signal having a varying magnitude over a given time period (such as that depicted in FIG. 4) and converts it into a corresponding electrical signal having a substantially constant magnitude over the appropriate time period. The electrical signal exiting the converter element 72 is amplified through an appropriate amplifier circuit 74 as is known in the art. The amplifier circuit 74 has an adjustable gain which permits the sensitivity of the apparatus 2 to be controlled. This sensitivity is adjustable by means of the sensitivity adjustment knob 42 located on the front panel 14 of the housing 16 as shown in FIG. 1. The adjustment knob 42 operates the wiper arm of a potentiometer 76 which is shown in FIG. 3.

The amplified signal is electrically filtered through an appropriate filtering circuit 78 and is connected to the input of a retriggerable monostable multivibrator 80, or "one-shot." The pulsed output from the multivibrator 80 is connected to a second amplifying means 82. The output of the second amplifying means 82 drives the blow indicator lamp 40 which is shown in FIG. 3 to be a light emitting diode 83. As the electrical signal triggers the multivibrator 80 and corresponding output pulses are generated thereby, the output pulses cause the light emitting diode 83 to flash thereby signifying individual hammer strikes of the pile for each flash of light. The light emitting diode 83, or more generally the blow indicator lamp 40, forms a portion of the display means 56 of the present invention.

In addition to being connected to the second amplifying means 82, the output of the multivibrator 80 is connected to an appropriate input of the blow rate processor means 54. The blow rate processor means 54 includes electronic computer means which is responsive to the sensing means 4 and the clock means 48 for computing the number of times the pile driving hammer 11 strikes the pile 10 during a predetermined time period. More particularly, the blow rate processor means 54 includes a microcomputer 84 having an integrated circuit microprocessor and memory. Stored within the memory is a suitable program for overseeing the operation of the microprocessor. The microcomputer 84 utilizes the pulsed output from the multivibrator 80 and the electrical timing signal from the clock means 58 to calculate the blow rate of the pile driving hammer 11.

As shown in FIG. 3, the clock means 58 particularly includes a crystal oscillator 86 connected to the appropriate input of the microcomputer 84. The output of the crystal oscillator 86 provides a time base for timing the operation of the microcomputer 84 under control of the stored program.

Although the microcomputer 84 normally functions under control of the stored program and therefore calculates the blow rate during a time period which is determined by the crystal oscillator 86 and the contents of the program, the microcomputer 84 can be manually controlled to effectively alter the time period during which the pulses are counted and the rate calculated. This is achieved by means of the rate period controller means 60 which controls the computer means so that the computer means computes the number of times the pile driving hammer 11 strikes the pile 10 during one of its plurality of selectable time periods. FIG. 3 indicates the rate period controller means 60 includes a count period select switch means 88 which is actuated in the preferred embodiment by depressing the count period select switch means push button control 38. The switch means 88 has a first terminal 90 connected to a first logic level, such as the ground potential, and has a second terminal 92 connected to a second logic level, such as a positive voltage, and to an appropriate control input of the microcomputer 84. In the preferred embodiment the control input is a program readable input so that when the switch means 88 is properly actuated, the program controlling the microcomputer 84 reads the control input and commences a new time period during which the blow rate is to be calculated. This time period extends until the switch means 88 is again actuated thereby marking the end of the selectable time period. By varying the time between successive depressions of the push button switch means 88, any one of a plurality of selectable time periods can be chosen during which the blow rate is to be calculated. This feature of the apparatus 2 causes the microcomputer 84 to determine and display the number of times the pile driving hammer 11 strikes the pile 10 to drive it a predetermined distance. For example, the switch means 88 can be actuated at a selected starting time and then reactuated each time the pile 10 is driven a selected distance, such as one foot. Upon each actuation of the switch means 88 after the first one, the number of strikes counted since the preceding actuation of the switch means will be displayed thereby giving the hammer 11 rate over a selected distance. Because it may take different amounts of time to drive the pile each additional foot, a variable time period during which the rate is calculated is also achieved. Alternatively, the switch means 88 can simply be actuated at selected time intervals without regard to the distance the pile has been driven.

Although not shown in FIG. 3, it is to be noted that a remotely controllable count period select switch means can be attached to the apparatus 2 at the connector means 44. This permits similar control of the microcomputer to be attained, but at a location remote from the housing 16.

So that other data may be input into the microcomputer 84 in addition to the information provided by the sensing means 4, the apparatus 2 further includes data entry means 62. FIG. 3 indicates the data entry means 62 includes thumbwheel switch means 46 having its outputs connected in parallel as shown in FIG. 3 and connected to the appropriate data input ports of the microcomputer 84. The thumbwheel switch means 41 includes multi-position, presettable switch means so that various types of data, particularly numerical data, can be entered into the microcomputer 84. For example, the length of the particular pile 10 to be driven can be entered so the distance it has been driven can be compared to its total length.

Once a blow rate has been calculated, it is output to the display means 56. FIG. 3 indicates the display means 56 can include the printer 24, a preferred embodiment of which has been previously mentioned to be a Datel Systems, Inc. DPP-7 printer. In the depicted preferred embodiment a serial data output from the microcomputer 84 is provided to respective ones of a plurality of integrated circuit latch means 96 wherein the respective digits of data to be displayed are retained. The respective one of the plurality of latches 96 in which data is to be stored is selected under control of output signals provided by the microcomputer 84 to a decoder/demultiplexer integrated circuit means 98. The location in the selected latch in which the serial data bit is to be stored is addressed by three output lines extending between the microcomputer 84 and the latches 96. It is to be noted that the display means 56 can also include other suitable devices, such as a chart recorder, a spectrum analyzer, an oscilloscope, a needle meter, light emitting diodes, liquid crystal displays or other suitable devices.

In the preferred embodiment depicted in FIG. 1 the printer 24 provides the printed output tape 22 having printed thereon numerical information which discloses particular information about the operation of the pile driving equipment. In FIG. 1 the illustrated output format of 1XXXXX (particularly 100018) indicates the number of pile driving hammer blows counted between successive depressions of the push button 88 (i.e., eighteen for the illustrated print-out).

The format 2XXXXX (particularly 200018) indicates the rate calculated during the predetermined time period. For example, if the predetermined time period were one minute, then the respective print-out with the leading numeral "2" illustrated in FIG. 1 indicates a blow rate of eighteen blows per minute.

An additional output format is 3XXXXX. The numerical information following the leading numeral "3" is data pertaining to the pile, such as the amount it has been driven.

The information conveyed by the portion of the readout 22 which has no leading numerical value is the time from the initial energization of the apparatus 2 or from the last actuation of a reset switch means 100 having the reset control button 36 associated therewith.

To energize the electrical circuitry of the apparatus 2, the present invention further includes the power source means 64. The power supply means 64 includes alternating current connector means 102 for electrically connecting the apparatus 2 to an alternating current power source and also includes direct current means 104 for electrically connecting the apparatus 2 to a direct current power source. FIG. 3 indicates the alternating current connector means 102 includes an appropriate fuse 106, a transformer 108, and rectifying circuitry 110 for providing an input to a first five-volt regulator means 112. The direct current connecting means 104 includes suitable circuit elements 114 as shown in FIG. 3 to provide an input to a second five-volt regulator means 116. Therefore, the power supply means 64 gives the present invention the versatility of being powered by either an alternating current source, such as a 60 Hz, 110 $V_{ac}$ source, or a direct current source, such as a 12 $V_{dc}$ source.

FIG. 3 further indicates that the apparatus 2 includes the reset switch means 100 which is connected to the appropriate reset input of the microcomputer 84 so that when the reset control button 36 is depressed, the microcomputer 84 reinitializes itself and commences a new computing period.

FIG. 3 further schematically depicts the take-up motor 34 which is located behind the hinged door 18 of the front panel 14 as shown in FIG. 1. The take-up motor 34 can be actuated by appropriate control signals generated by the microcomputer 84 to control a first switching transistor 118, shown in FIG. 3 as a power FET. The take-up motor is also controlled by a manual paper take-up switch means 30 and actuating button 32, which is illustrated in FIG. 1. The paper take-up switch means 30 controls a second switching transistor 120 (also shown as a paper FET) which is appropriately connected to the take-up motor 34. When either of the transistors 118 or 120 is appropriately switched by the microcomputer 84 or by the paper takeup switch 30, respectively, the paper take-up motor 34 is energized and draws in the printed output tape 22.

To operate the apparatus 2 of the present invention, the sensing means 4, in particular the hydrophone 6 for the preferred embodiment, is connected to the input jack 12 located on the front panel 14 of the housing 16 and is then dropped into the fluid 8 in spaced relation to the pile driving equipment which is to be monitored and evaluated.

Next, a remote count period select switch means is connected to the connector means 44 located on the front panel 14 of the housing 16.

Any data to be input into the microcomputer 84 is entered into the thumbwheel switch means 46, and then the on/off power switch means 18 is placed in the "on" position to energize the apparatus 2. To enter the data from the thumbwheel switch means 46 into the microcomputer 84, the reset control button 36 is depressed so that the reset switch means 100 closes and resets the microcomputer 84. This actuation of the reset button 36 also resets to zero the accumulated time maintained by the microcomputer 84.

As the pile driving equipment operates so that pressure waves are generated by the pile driving hammer 11 striking the pile 10 and as the pressure waves are received by the hydrophone 6, the sensitivity of the circuit thereto may be adjusted by appropriately manipulating the sensitivity adjustment knob 42. The sensitivity is set so that blow indicator lamp 40 is illuminated for each hammer blow and is extinguished between successive blows.

The received pressure waves are converted into proportional digital electrical signals by the signal conditioning means 52. The digital electrical "striking" signals are appropriately counted by the processor means 54 so that the rate at which the hammer 11 strikes the pile 10 can be determined by dividing the count by the predetermined time period. If either the local count period switch means 88 or the remote count period switch means is actuated, the processor means 54 also accumulates the number of hammer strikes which are detected prior to the next actuation of the count period switch means. The computer results are displayed as previously described.

Thus, the present invention is well adapted to carry out the objects and attain the ends and advantages mentioned above as well as those inherent therein. While preferred embodiments of the invention have been described for the purpose of this disclosure, numerous changes in the construction and arrangement of parts can be made by those skilled in the art, which changes are encompassed within the spirit of this invention as defined by the appended claims.

The embodiments of this invention in which an exclusive property or privilege is claimed are defined as follows:

1. An apparatus for remotely monitoring and evaluating the rate at which a pile driving hammer strikes a pile located in a liquid, said apparatus comprising:

sensing means comprising a hydrophone, disposed in the liquid remotely from the pile driving hammer and the pile, for sensing a pressure wave generated by the pile driving hammer striking the pile and for generating an analog electrical striking signal proportional to the sensed pressure wave;

electrical signal conditioning means for converting the analog electrical signal to a digital electrical striking signal being electrically connected to said hydrophone;

clock means for providing an electrical timing signal;

integrated circuit computer means, responsive to the digital electrical striking signal and the electrical timing signal, for computing a first value indicating the rate at which the pile driving hammer strikes the pile during a predetermined time period;

switch means, connected to said computer means, for effectively altering the predetermined time period so that said computer means computes a second value indicating the number of hammer strikes which occurred during the effectively altered time period; and display means for displaying the computed first and second values.

2. An apparatus as defined in claim 1, further comprising multi-position presettable switch means, connected to said computer means, for communcating numerical data to said computer means.

3. An apparatus as defined in claim 2, further comprising power supply means, including:

alternating current connector means for electrically connecting said apparatus to an alternating current power source; and direct current connector means for electrically connecting said apparatus to a direct current power source.

4. An apparatus for remotely monitoring and evaluating the rate at which a pile driving hammer strikes a pile located in a liquid, said apparatus comprising:

sensing means, disposed in the liquid remotely from the pile driving hammer and the pile, for sensing a pressure wave generated by the pile driving hammer striking the pile and for generating an analog electrical striking signal proportional to the sensed pressure wave;

electrical signal conditioning means for converting the analog electrical signal to a digital electrical striking signal;

clock means for providing an electrical timing signal;

integrated circuit computer means, responsive to the digital electrical striking signal and the electrical timing signal, for computing the rate at which the pile driving hammer strikes the pile during a predetermined time period;

multi-position, presettable switch means, connected to said computer means, or communicating numerical data to said computer means; and display means for displaying the computed striking rates.

5. An apparatus as defined in claim 4, wherein said sensing means includes a hydrophone electrically connected to said electrical signal conditioning means.

6. An apparatus for remotely monitoring and evaluating the rate at which a pile driving hammer strikes a pile located in a liquid, said apparatus comprising:

a hydrophone, disposed in the liquid remotely from the pile driving hammer and the pile, for sensing a pressure wave generated by the pile driving hammer striking the pile and for generating an analog electrical striking signal proportional to the sensed pressure wave;

electrical signal conditioning means for converting the analog electrical striking signal to a digital electrical striking signal;

clock means for providing an electrical timing signal;

integrated circuit computer means, responsive to the digital electrical striking signal and the electrical timing signal, for computing the rate at which the pile driving hammer strikes the pile during a predetermined time period; and display means for displaying the computed rate.

7. A method of remotely monitoring and evaluating the rate at which a pile driving hammer strikes a pile located in a liquid, comprising the steps of:

placing a hydrophone in the liquid remotely from the pile driving hammer and the pile for sensing pressure waves generated when the pile driving hammer strikes a pile;

providing an electrical timing signal;

utilizing electronic computer means for computing the number of times the pile driving hammer strikes the pile during a predetermined time period; and displaying the computed number of hammer strikes which occurred during the predetermined time period.

8. A method as defined in claim 7, further comprising the step of controlling the computer means so that the computer means computes the number of times the pile driving hammer strikes the pile during one of a plurality of selectable time periods.

9. A method as defined in claim 8, wherein the step of controlling the computer means is performed each time the pile is driven a predetermined distance.

10. A method as defined in claim 8, further comprising the step of communicating data to the computer means.

11. A method as defined in claim 7, further comprising the step of communicating data to the computer means.

* * * * *